United States Patent [19]

Otsuki et al.

[11] Patent Number: 5,038,557

[45] Date of Patent: Aug. 13, 1991

[54] ADJUSTABLE WATCH BAND HAVING MULTI-PART LINK UNITS

[75] Inventors: Shigeru Otsuki; Kouji Ushikubo, both of Tokyo, Japan

[73] Assignee: Citizen Watch Co., Ltd., Japan

[21] Appl. No.: 445,643

[22] PCT Filed: Mar. 23, 1989

[86] PCT No.: PCT/JP89/00307

§ 371 Date: Jan. 22, 1990

§ 102(e) Date: Jan. 22, 1990

[87] PCT Pub. No.: WO89/08997

PCT Pub. Date: Oct. 5, 1989

[30] Foreign Application Priority Data

Mar. 23, 1988 [JP] Japan ..... 63-72194
Sep. 5, 1988 [JP] Japan ..... 63-220457

[51] Int. Cl.[5] ..... F16G 15/12

[52] U.S. Cl. ..... 59/80; 59/84; 59/85; 63/4

[58] Field of Search ..... 59/78, 80, 82, 84, 85, 59/901; 63/4

[56] References Cited

U.S. PATENT DOCUMENTS 4,930,304 6/1990 Meister ..... 59/80

FOREIGN PATENT DOCUMENTS 2744370 4/1979 Fed. Rep. of Germany ..... 59/80
47-25569 8/1972 Japan .
56-32085 7/1981 Japan .
0269271 5/1951 Switzerland ..... 59/80
0392958 10/1965 Switzerland ..... 59/80
0467597 3/1969 Switzerland ..... 59/80
0661416 7/1987 Switzerland ..... 59/82

*Primary Examiner*—David Jones
*Attorney, Agent, or Firm*—Birch, Stewart, Kolasch & Birch

[57] ABSTRACT

A watch band having length adjusting function is disclosed. The band is formed by connecting a plurality of link units (14). Each of the link units comprises a first link (10) and a second link (11). The first and second links (10, 11) have bodies (10*b*, 11*b*) and projections (10*c*, 11*c*) projecting from inner portions of the bodies. The bodies have holes (10*a*, 11*a*) extending in the lateral direction, and the projections have perforated holes (15) extending in the lateral direction. Adjacent link units are connected by engaging a pin with the holes. Structure (12*a*, 13) is provided for preventing the first and second links from moving in the lateral direction in an approximately flat state, and for allowing the lateral movement of the links when both the links are relatively angularly displaced about the pin.

3 Claims, 12 Drawing Sheets

FIG. 4
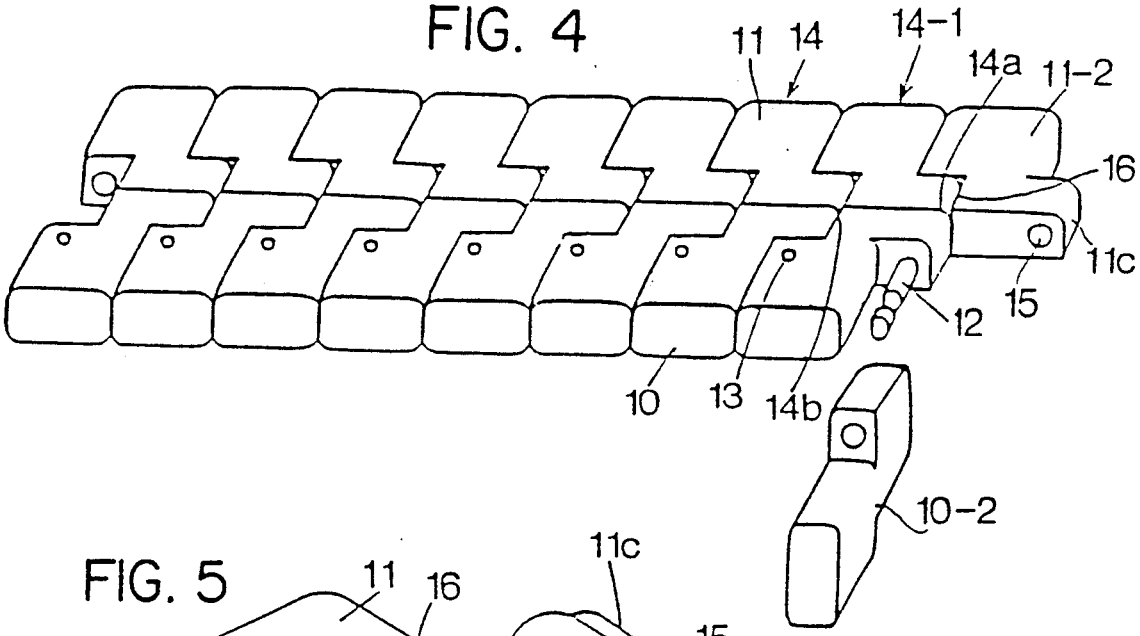
FIG. 5
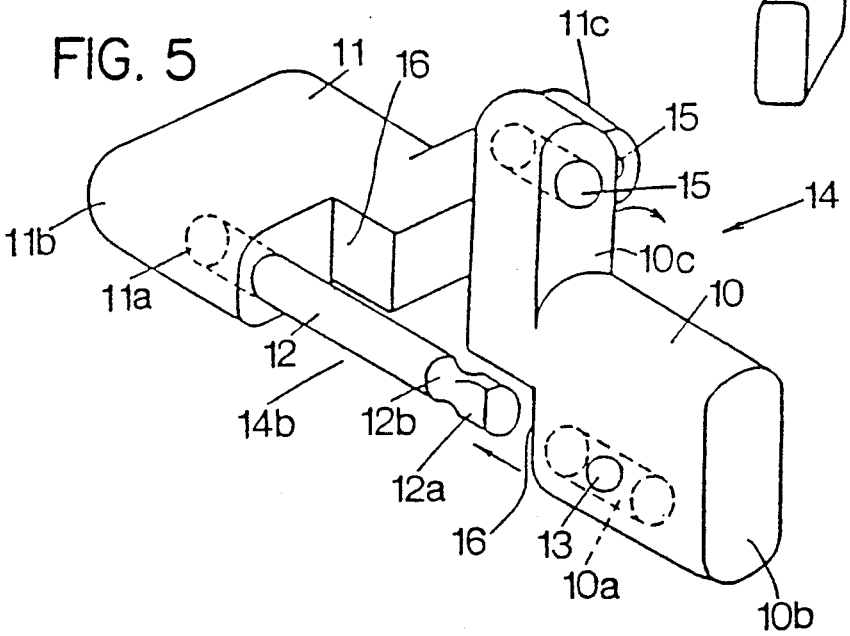
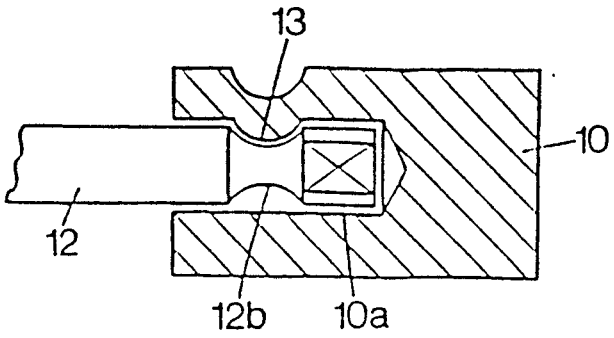
FIG. 6

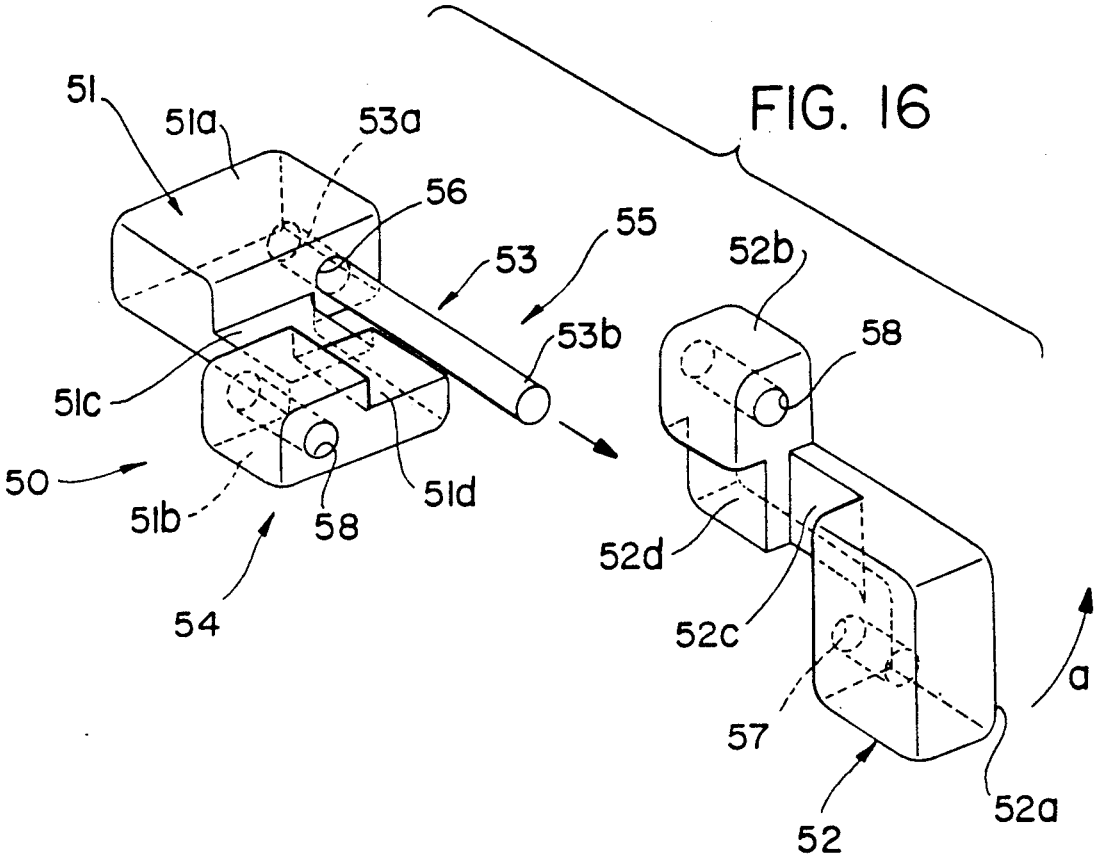
FIG. 16
FIG. 17
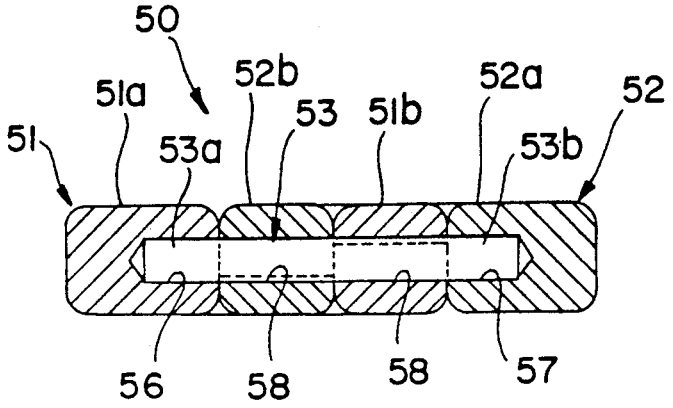

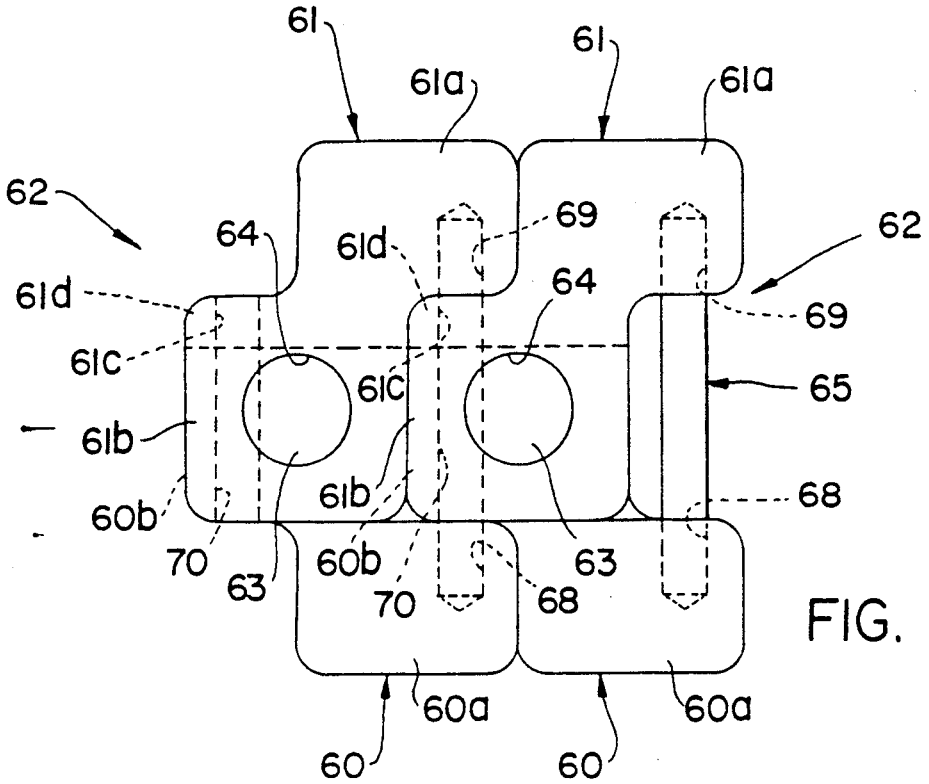
FIG. 18
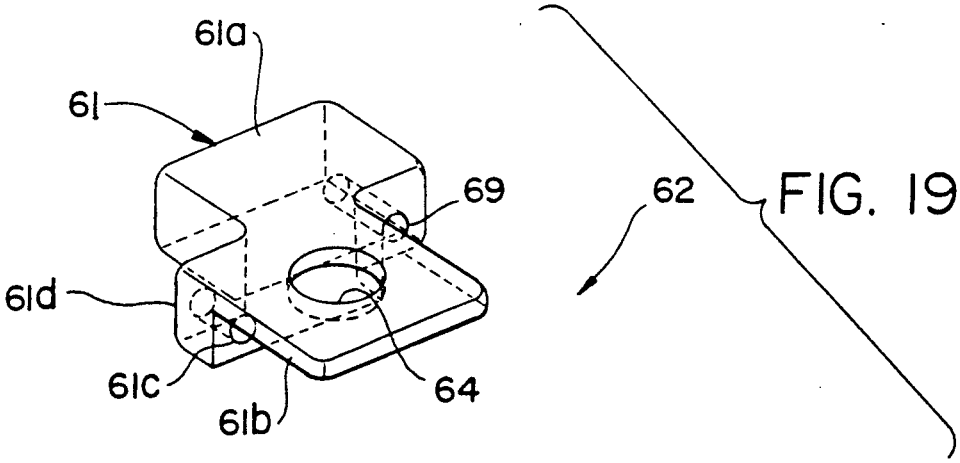
FIG. 19
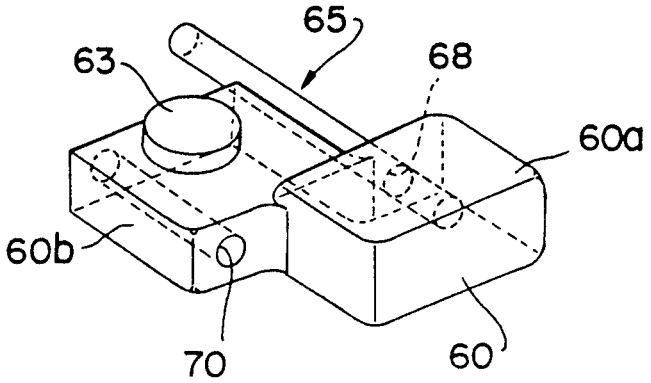

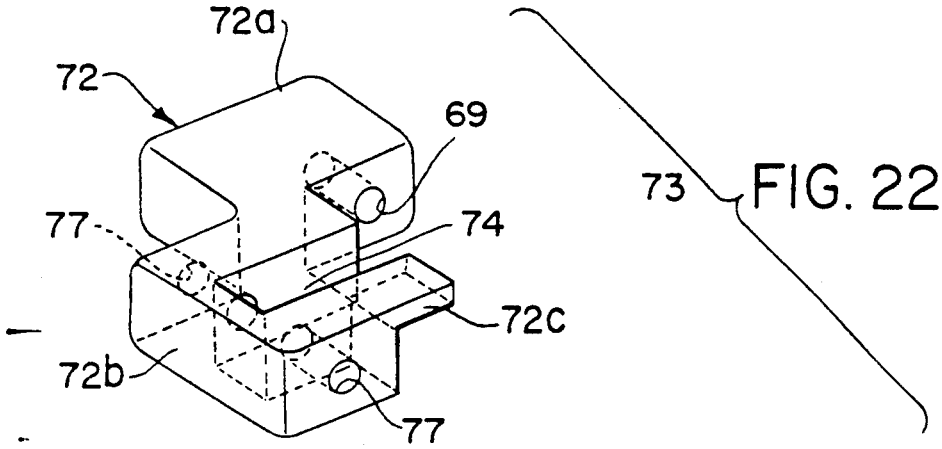
FIG. 22
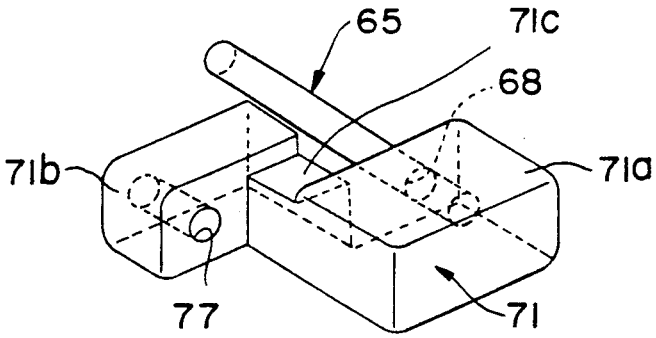
FIG. 23
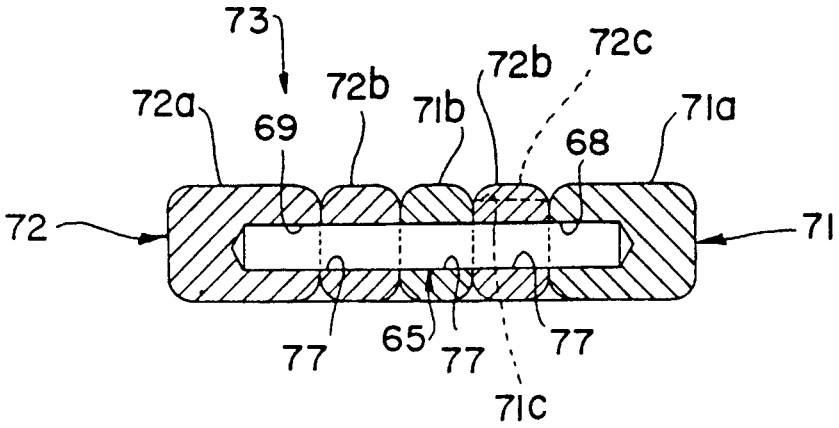

ADJUSTABLE WATCH BAND HAVING MULTI-PART LINK UNITS

TECHNICAL FIELD

The present invention relates to a band for a watch, and more particularly to a watch band the length of which is adjustable to fit the watch to the wrist of the wearer.

Japanese Utility Mode Application Laid-Open 53-45065 discloses structure for connecting links of a watch band, which is shown in FIGS. 1 to 3.

The watch band comprises a link unit 4 consisting of a plurality of inner links 1 and a pin 3 rotatably engaged with a hole formed in each link 1, and a pair of outer links 2 secured to the pin 3 on opposite sides of the link unit 4. To assemble the link unit 4, an annular groove 3*a* formed on an end of the pin 3 is positioned so as to correspond to a staking portion 2*a* of the outer link 2. The staking portion 2*a* is pressed down by a press to project a protrusion 2*b* to the portion 3*a*, thereby fixing the pin 3 in the outer link 2.

However, the length of the band can not be adjusted, because the outer links 2 can not be removed. Therefore, an adjusting link having an adjusting function must be provided.

An object of the present invention is to provide a watch band which has a length adjusting function, whereby the operation for the connection or disconnection of the links is easily performed.

Another object of the invention is to provide a watch band in which color tones and patterns of links are easily changed.

DISCLOSURE OF THE INVENTION

The watch band of the present invention has a plurality of link units, each of the link units having an engaging projection projecting from one of sides of the link unit in the longitudinal direction of the band and a recess formed in the other side, corresponding to the engaging projection, adjacent link units being connected by engaging the engaging projection of one of the units with the recess of the other unit and is characterized in that each of the link units comprises a first link and a second link, each of the first and second links has a body and a projection projecting from an inner portion of the body in the lateral direction and the longitudinal direction of the band, the body has a hole extending in the lateral direction, the projection has a through hole extending in the lateral direction of the band, the projection of first link having a shape so as to form the engaging projection of the link unit by adjoining with the projection of the second link, a connecting pin is engaged with the hole of the body of the first link unit, with the through holes of the engaging projection of the second link unit adjacent to the first link unit, and with the hole of the second link of the first link unit, means is provided for preventing the first and second links from moving in the lateral direction of the band when the links are approximately co-planar, and for allowing the lateral movement of the links when both the links are relatively angularly displaced about the pin.

BRIEF DESCRIPTION OF THE DRAWINGS

FIG. 4 is a perspective view showing the reverse side of a watch band according to the present invention;

FIG. 5 is a perspective view for explaining an assembling process of links of the band;

FIG. 6 is a sectional view partly showing a connecting pin and a link of the band in an engaged state;

FIG. 16 is a perspective view showing an assembling process of links;

FIG. 17 is a sectional view showing link units in a connecting state;

FIG. 18 is a plan view showing a seventh embodiment;

FIG. 19 is an exploded perspective view showing a link unit of FIG. 19;

FIG. 22 is an exploded perspective view showing a link unit of FIG. 21;

FIG. 23 is a sectional view showing link units in a connecting state;

BEST MODE FOR EMBODYING THE INVENTION

Figure 1:
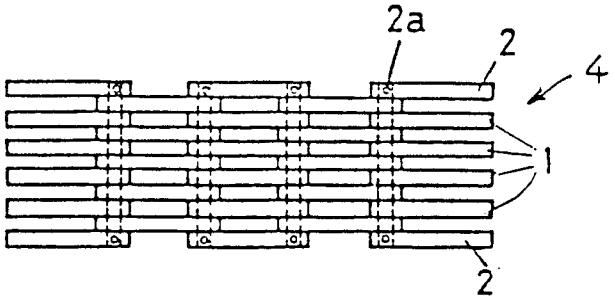
FIG. 1 is a plan view of the reverse side of a conventional watch band.
Figure 2:
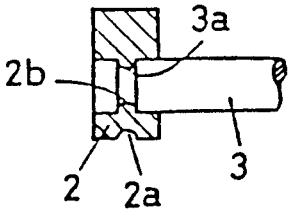
FIG. 2 is a sectional view showing a staking portion of the watch band of FIG. 1.
Figure 3:
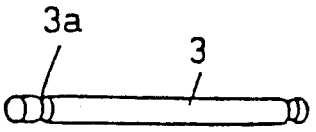
FIG. 3 is a perspective view showing a connecting pin of the band of FIG. 1.

The preferred embodiments of the present invention will be described hereinafter in detail with reference to the accompanying drawings.

Referring to FIGS. 4 to 6 showing the first embodiment of a watch band according to the present invention, a link unit 14 comprises a first link 10 and a second link 11. Each of the links 10 and 11 comprises a body 10*b* (11*b*), and an L-shaped projection 10*c* (11*c*) projecting from an inner portion of the body. Thus, each link has a crank shape. The link unit 14 is formed by adjoining the links 10 and 11 at the insides of the projections 10*c* and 11*c*. The link unit 14 has a connecting projection 14*a* formed with the projections 10*c* and 11*c*, projecting from one of the sides of the link unit 14 in the longitudinal direction of the band. A recess 14*b* is formed on the other side of the link unit 14 by combining a notch portion 16 of the link 10 and a notch portion 16 of the link 11. The connecting projection 14*a* is arranged to be engaged with the recess 14*b* of the adjacent link unit 14.

Each of the projections 10*c* and 11*c* of links 10 and 11 has a through hole 15 formed in the lateral direction of the band. The notch portions 16 have blind holes 10*a* and 11*a*, respectively, formed in the lateral direction of the band corresponding to each other. As shown in FIG. 6, in the hole 10*a* of the link 10, an inner protrusion 13 is formed projecting from the inside wall of the hole in the perpendicular direction to the surface of the link.

A cylindrical pin 12 for connecting the first link 10 with the second links 11 and for connecting the adjacent link units 14 has a flat portion 12*a* at an end thereof and an annular groove 12*b* at the inner side of the flat portion 12*a*, with the base of the groove being flush with the flat portion 12*a*. The flat portion 12*a* is formed so as to pass the inner protrusion 13 passing through the surface thereof.

Operation for connecting the links 10 and 11 together with the adjacent link units 14 will be described hereinafter with reference to FIGS. 4 to 6.

A base end of the pin 12 is securely mounted in the hole 11*a* of the second link 11-2 with force fit, staking or welding. In that state, the flat portion 12*a* of the pin 12 is positioned at a right angle with the surface of the link 11-2. An end of the pin 12 secured to the second link 11-2 is inserted into the through holes 15 of the assembled adjacent link unit 14-1. Then, the first link 10-2 is positioned at the right angle to the link 11-2 so that the flat portion 12*a* becomes parallel with the surface of the link 10-2. The end of the pin 12 is inserted into the hole 10*a*, passing the protrusion 13 in the hole 10*a*. The annular groove 12*b* is positioned at the protrusion 13, and the link 10-2 is rotated 90° so as to become coplanar with the link 11-2, rotating the protrusion 13 in the annular groove 12*b*. The link 10-2 is restricted from moving in the lateral direction because of the engagement of the protrusion 13 with the groove, whereby the link 10-2 is prevented from coming off. Thus, the adjacent link units are connected.

As described above, the first link 10 and the second link 11 are connected by the pin 12 to form the link unit 14, and the connecting projection 14*a* of the link unit 14 is engaged with the connecting recess 14*b* of the adjacent link unit 14. Thus, the watch band having a length adjusting function is assembled.

The height of the protrusion 13 is selected to be slightly lower than the flat portion 12*a* of the pin 12 and higher than the position of the outer diameter of the pin 12. Thus, the end of the pin 12 can be engaged with the hole 10*a* only when the flat portion 12*a* corresponds to the protrusion 13. In the other position relationships between the flat portion and the protrusion, the pin 12 cannot engage with the hole 10*a*.

The flat portion 12*a* of the pin 12 inserted into the hole 10*a* passes the protrusion 13 and the annular groove 12*b* is positioned at the protrusion 13, and the link 10 or 11 is rotated 90° so that the protrusion 13 is engaged with the annular groove 12*b*. Thus, the link 10 is not removed from the pin 12.

In order to adjust the length of the band, the link 10 and the link 11 are disconnected in the reverse order to the connection order. Namely, either of the link 10 and the link 11 is rotated to position the flat portion 12*a* of the pin 12 at the protrusion 13. Then, the link 10 and the link 11 are pulled in the opposite directions so that the link unit 14 is disassembled.

In accordance with the invention, operations for connection and disconnection of the link units 14 are easily performed.

The protrusion 13 is formed in various methods such as punching, press working, or embedding of a pin or a screw.

Figure 7:
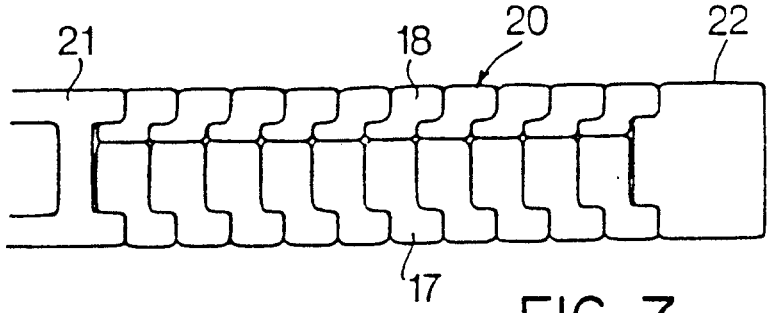
FIG. 7 is a plan view showing a second embodiment of the present invention.

FIG. 7 shows the second embodiment of the invention. Although the first and second links 10 and 11 of the first embodiment are symmetrical in shape, a first link 17 and a second link 18 of the second embodiment are asymmetrical. The contact surfaces of both links 17 and 18 composing a link unit 20 is deflected to the side of the link 18, thereby giving variety to the design of the band.

Structures of the link unit 20 and method for connecting the links 17 and 18 and connecting the link units 20 are the same as the first embodiment. Thus, descriptions thereof are omitted. An end of the band is connected to a watch case 21 and the other end thereof is connected to a buckle 22 by spring loaded pins (not shown), respectively.

Figure 8:
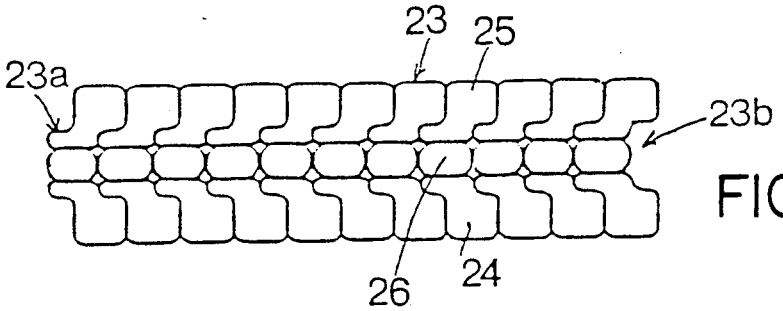
FIG. 8 is a plan view showing a third embodiment.
Figure 9:
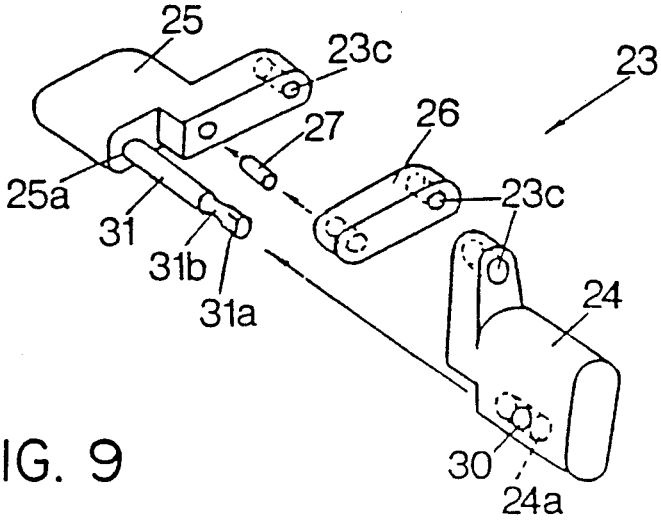
FIG. 9 is a perspective view explaining an assembling process of links of the third embodiment.

FIGS. 8 and 9 show the third embodiment of the invention. A link unit 23 comprises a first link 24, a second link 25 and an intermediate link 26 disposed between the first and second links. The link unit 23 has a connecting projection 23*a* projecting in the longitudinal direction of the band, which is formed by combining a projection of the first link 24, the intermediate link 26 and a projection of the second link 25. A recess 23*b* is formed on the opposite side to the connecting projection 23*a* by a notch portion of the first link 24, an end of the intermediate link 26 and a notch portion of the second link 25.

The connecting projection 23*a* has through holes 23*c* formed in the lateral direction of the band. The intermediate link 26 is connected to the link 24 or 25 through a connecting pin 27 at an end portion opposite to the end portion having the hole 23*c*.

The first link 24 has a hole 24*a* having a protrusion 30 formed in the hole, and the second link 25 has a hole 25*a* corresponding to the hole 24*a*.

A pin 31 for connecting the links 24 and 25 has the same structure as the pin 12 of the first embodiment. That is, the pin 31 has a flat portion 31*a* and an annular groove 31*b*.

Operation for engaging the first link 24 with the second link 25 and connecting the link units 23 will be described in brief.

An end of the pin 31 is securely mounted in the hole 25*a* of the second link 25. The pin 31 is inserted into through holes 23*c* of the adjacent link unit 23 and further engaged with the blind hole 24*a* of the first link 24. The first link 24 is rotated 90° to engage the protrusion 30 with the annular groove 31*b* of the pin 31.

Thus, the first link 24, intermediate link 26 and second link 25 are engaged by the pin 31 to form the link unit 23. The connecting projection 23*a* of the link unit 23 is engaged with the recess 23*b* in order. Thus, the watch band having the intermediate link 26 is assembled. In the third embodiment, the intermediate link is disposed between first and second links.

Figure 10:
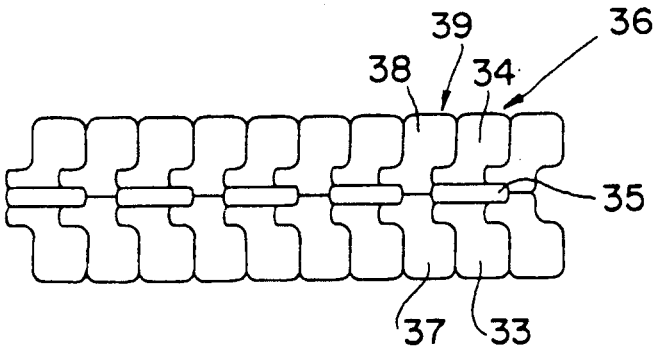
FIG. 10 is a plan view showing a fourth embodiment.

Referring to FIG. 10 showing the fourth embodiment, a watch band comprises a link unit having a connecting link and a link unit without the connecting link, which are alternately arranged. Namely, a link unit 36 comprises a first link 33, a second link 34 and an intermediate link 35 disposed between the first and second links, and a link unit 39 comprises a first link 37 and and a second link 38, which are connected by pins (not shown).

The intermediate link 35 is connected to the link unit 36 by a pin for assembling the first links 33, 37, the second links 34, 38, the link unit 36 and the link unit 39, such as pin 12 in the first embodiment, without using the pin 27 of the third embodiment.

Operation for connecting the links and link units 36 and 39 is the same as the first and third embodiments so that the description thereof is omitted.

Figure 11:
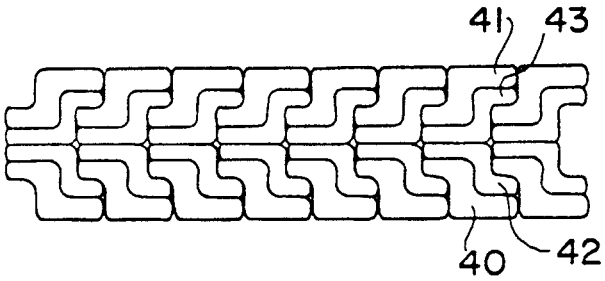
FIG. 11 is a plan view showing a fifth embodiment.

Referring to FIG. 11 showing the fifth embodiment, a link unit comprises a first link 40 having an intermediate link 42 having approximately the same shape as the first link and a second link 41 having an intermediate link 43 having approximately the same shape as the second link. The first link 40 and the second link 41 and the adjacent link units are connected by a pin in the same manner as the first embodiment.

The number of the intermediate links can be increased to a larger even number such as four and six, whereby the color tone and pattern of the band can be easily changed. Thus, a variety of watch bands can be provided.

Figure 12:
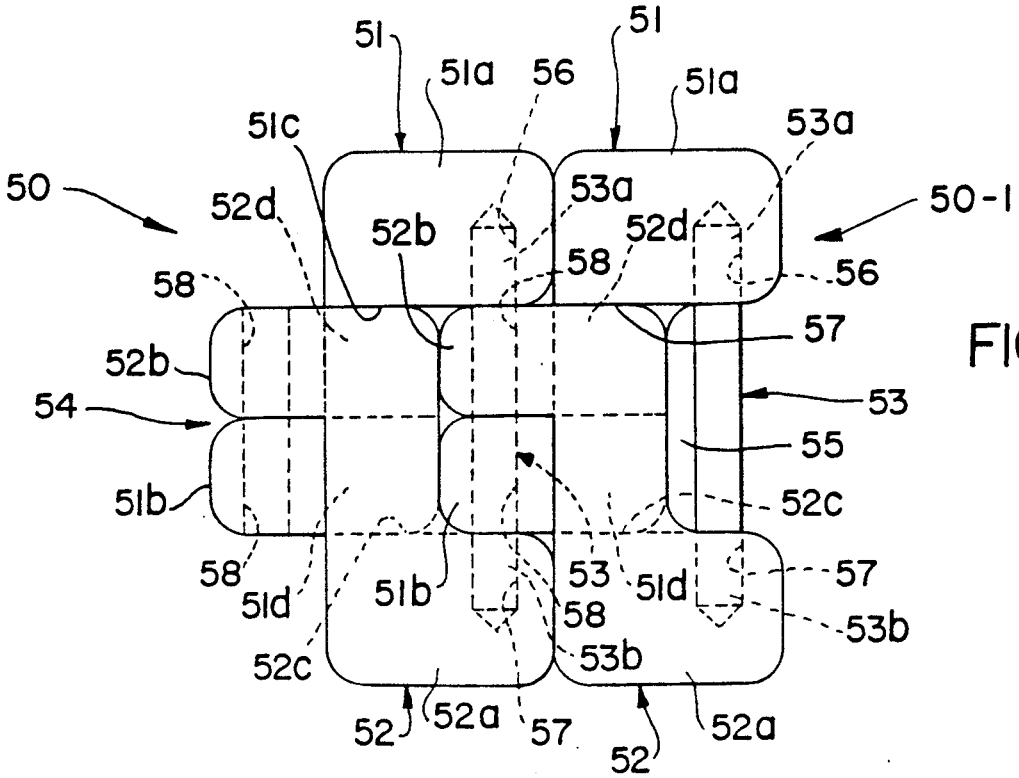
FIG. 12 is a plan view showing a sixth embodiment.

FIGS. 12 to 17 show the sixth embodiment. Referring to FIG. 12, numeral 50 designates a link unit having a first link 51 and a second link 52. The first link 51 and the second link 52 have bodies 51*a* and 52*a*, and L-shaped engaging projections 51*b* and 52*b* projected from the inner sides of the bodies 51*a* and 52*a*, respectively. Thus, each link 51 (52) has a crank shape.

Figure 13:
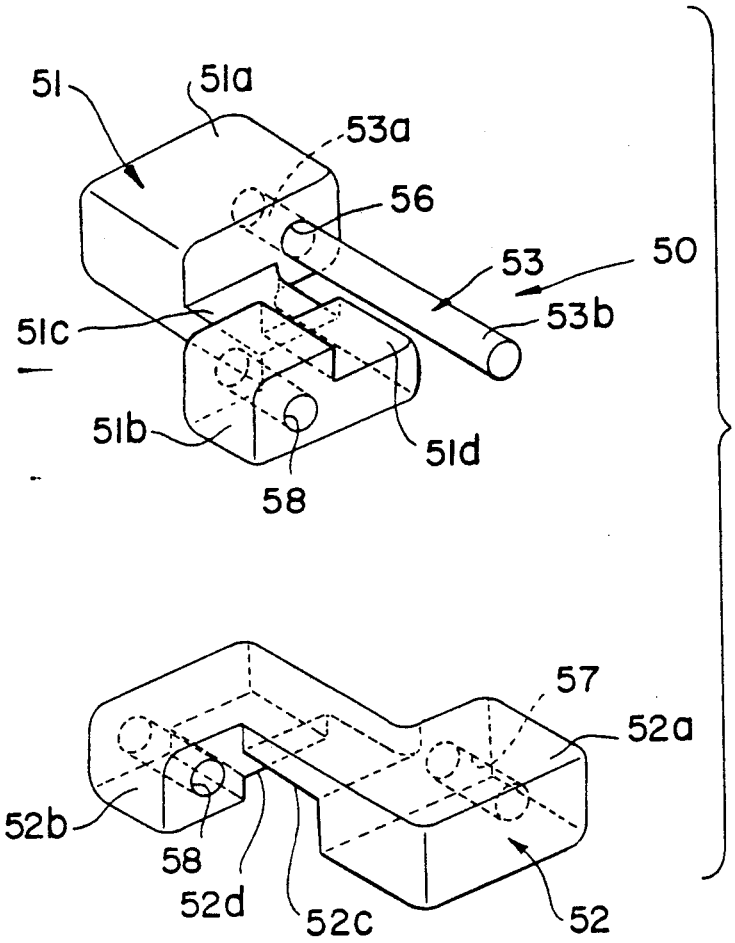
FIG. 13 is an exploded perspective view showing a link unit of the sixth embodiment.

Referring to FIG. 13, the first link 51 has a recess 51*c* formed on an arm portion thereof and an engaging step portion 51*d* formed adjacent the recess 51*c* one step higher than the recess. The second link 52 has a recess 52*c* formed on the underside of an arm portion thereof to be engaged with the step portion 51*d* and an engaging step portion 52*d* engaged with the recess 51*c*. Namely, when both links are assembled, the arm portions of the links are adjoined each other with respect to the direction of the thickness of the band. Further, engaging projections 51*b* and 52*b* are engaged with each other at reverse sides, so as to regulate the lateral displacements of the links.

The first link 51 and the second link 52 are assembled by a pin 53 to form the link unit 50 as described hereinafter. As shown in FIG. 12, a connecting projection 54 is formed with the engaging projection 51*b* of the first link 51 and the engaging projection 52*b* of the second link 52, projecting from one of the sides of the link unit 50 in the longitudinal direction of the band. A recess 55 is formed on the other side of the link unit 50 between the body 51*a* of the link 51 and the body 52*a* of the link 52 so as to be engaged with a connecting projection 54 of an adjacent link unit 50.

Figure 14:
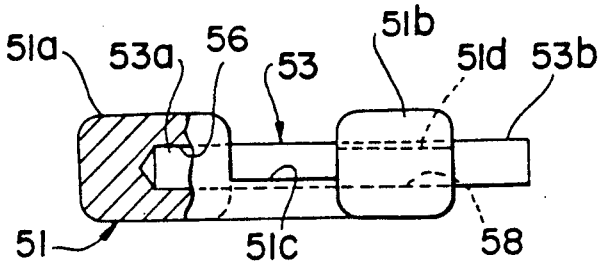
FIG. 14 is a front view of a first link of the sixth embodiment partly shown in section.
Figure 15:
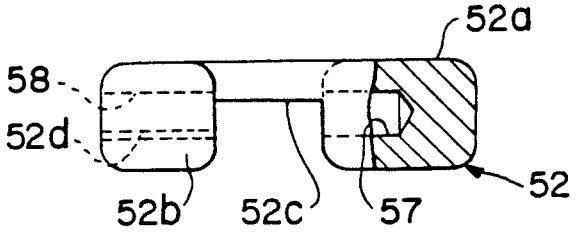
FIG. 15 is a front view of a second link partly shown in section.

As shown FIGS. 13 and 14, the body 51*a* of the first link 51 has a blind hole 56 formed in the inner side thereof, extending in the lateral direction of the band for engaging an end 53*a* of the pin 53. As shown in FIG. 15, the body 52*a* of the second link 52 has a blind hole 57 formed in the inner side thereof corresponding to the blind hole 56 for engaging the other end 53*b* of the pin 53. The engaging projection 51*b* of the link 51 and the engaging projection 52*b* of the link 52 have through holes 58 extending in the lateral direction of the band for engaging the pin 53.

Operation for connecting the links 51 and 52 and the link units 50 will be described hereinafter.

Referring to FIG. 16, the end 53*a* of the first pin 53 is inserted into the hole 56 formed in the body 51*a* of the first link 51. The second link 52 is positioned at an angle of 90° to the first link 51, and the other end 53*b* of the pin 53 is inserted into the hole 57 formed in the body 52*a* of the second link 52.

The link 52 is rotated 90° about the pin 53 in the direction shown by an arrow a so as to flush the surface of the link 51 with the surface of the link 52. The recess 51*c* provided on the engaging projection 51*b* of the link 51 is engaged with the engaging step portion 52*d* provided on the engaging projection 52*b* of the link 52, while the recess 52*c* of the engaging projection 52*b* of the link 52 is engaged with the engaging step portion 51*d* of the engaging projection 51*b* of the link 51 to form a first link unit 50-1 of FIG. 12. The links 51 and 52 are not disengaged from the pin 53 because of the engagement of the projections with the recesses and step portions.

An end 53*a* of a second pin 53 inserted into a hole of a second link 52 of an adjacent second link unit 50 is inserted into the through holes 58 formed in the engaging projections 51*b* and 52*b* of the links 51 and 52 of the first link unit 50-1.

A first link 51 of the adjacent second link unit 50 is positioned at an angle of 90° to the second link 52, and the end 53*a* of the second pin 53 is inserted into a hole 56 of the first link 51 of the second link unit 50.

The first link 51 is rotated 90° about the pin 53 in the upward direction. The recess 51*c* provided on the engaging projection 51*b* of the link 51 is engaged with the engaging step portion 52*d* provided on the engaging projection 52*b* of the link 52, while the recess 52*c* of the engaging projection 52*b* of the link 52 is engaged with the engaging step portion 51*d* of the engaging projection 51*b* of the link 51. The connecting projection 54 formed on the side of the link unit 50-1 is connected to the recess 55 formed on the other side of the adjacent second link unit 50 by the second pin 53. As shown in FIG. 17, the engaging projection 52*b* of the link 52 and the engaging projection 51*b* of the link 51 of the adjacent link unit disposed between the body 51*a* of the link 51 and the body 52*a* of the link 52 are supported by the pin 53. Thus, the watch band with link adjusting function is assembled.

In order to disconnect the link from the band, the links 51 and 52 are disconnected in the reverse order as described hereinbefore. That is, the first link 51 is rotated 90° in the downward direction 90° so that the recess 51*c* of the link 51 is disengaged from the engaging step portion 52*d* of the link 52, while the recess 52*c* of the link 52 is disengaged from the engaging step portion 51*d* of the link 51.

The links 51 and 52 are pulled in the opposite directions along the axial direction of the pin 53. The pin 53 is released from the blind hole 57 of the link 52 and from the through holes 58 of the adjacent links 51 and 52 so that the link unit 50 is disengaged. Thus, it is possible to adjust the length of the band.

In this embodiment, the recesses 51*c*, 52*c* and the engaging step portions 51*d* and 52*d* may have the same level.

Figure 20:
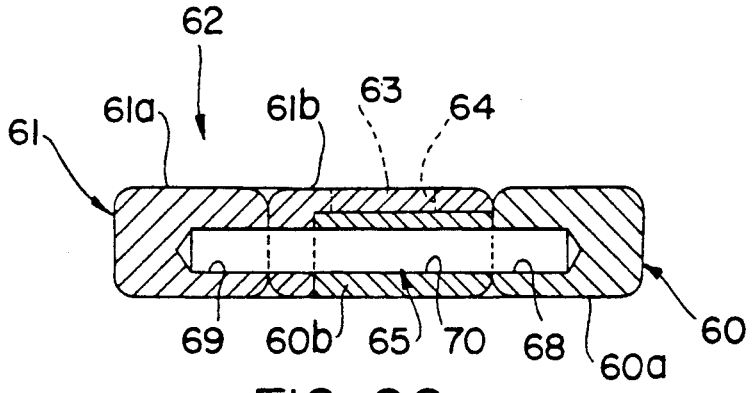
FIG. 20 is a sectional view showing link units in a connecting state.

Referring to FIGS. 18 to 20 showing the seventh embodiment, a link unit 62 comprises a first link 60 and a second link 61. As shown in FIG. 19, the first link 60 has a body 60*a* and a thick projection 60*b* projected from the inner side of the body 60*a* to the second link 61. The second link 61 has a body 61*a*, a lower projection 61*d* formed on the inner side of the body 61*a*, and a thin projection 61*b* projected from the lower projection to the link 60. A cylindrical protrusion 63 is provided on the thick projection 60*b* of the link 60. On the thin projection 61*b* of the link 61, an engaging opening 64 is formed so as to engage with the protrusion 63.

The body 60*a* of the link 60 has a blind hole 68 for engaging an end of a pin 65. The body 61*a* of the link 61 has a blind hole 69 formed in correspondence to the hole 68.

The thick projection 60*b* of the link 60 has a perforated hole 70 for engaging the pin 65. The lower projection 61*d* of the link 61 has a perforated hole 61*c* corresponding to the hole 70. When the links 60 and 61 are assembled, the thin projection 61*b* of the link 61 is adjoined on the thick projection 60*b* of the link 60.

When the links 60 and 61 are rotated about the pin 65, the protrusion 63 of the link 60 is engaged with the engaging opening 64 of the link 61. With the reverse rotation of the links 60 and 61 about the pin 65, the protrusion 63 of the link 60 is disengaged from the engaging opening 64 of the link 61.

Operation for connecting the links 60 and 61 and the link units 62 will be described hereinafter.

The end of the pin 65 is inserted into the hole 68 of the first link 60. The link 61 is positioned at an angle of 90° to the link 60 and the other end of the pin 65 is inserted into the blind hole 69 of the link 61 in the same manner as the sixth embodiment.

The link 61 is rotated 90° about the pin 65 so as to flush the surface of the body 60*a* of the link 60 with the surface of the base body 61*a* of the link 61. The protrusion 63 provided on the thick projection 60*b* of the link 60 is engaged with the engaging opening 64 of the link 61, while the thin projection 61*b* of the link 61 is engaged with the thick projection 60*b* of the link 60, so that the link unit 62 is formed. The links 60 and 61 are not released from the pin 65.

An end of another pin 65 inserted into the blind hole 68 of link 60 of the adjacent link unit 62 is inserted into the perforated hole 70 of the link 60 and the perforated hole 61*c* formed in the lower projection 61*d* of the link 61 of the assembled link unit 60.

The link 61 of the adjacent link unit 62 is positioned at an angle of 90° to the link 60 and an end of the pin 65 is inserted into hole 69 of the link 61.

The link 61 is rotated 90° about the pin 65 so as to flush the surface of the body 60*a* of the link 60 with the surface of the body 61*a* of the link 61 so that the protrusion 63 of the link 60 is engaged with the engaging opening 64 of the link 61. Thus, the link units 62 are connected with each other.

In order to disconnect the link from the band, the reverse manner of engaging the link 60 with the link 61 is performed.

Figure 21:
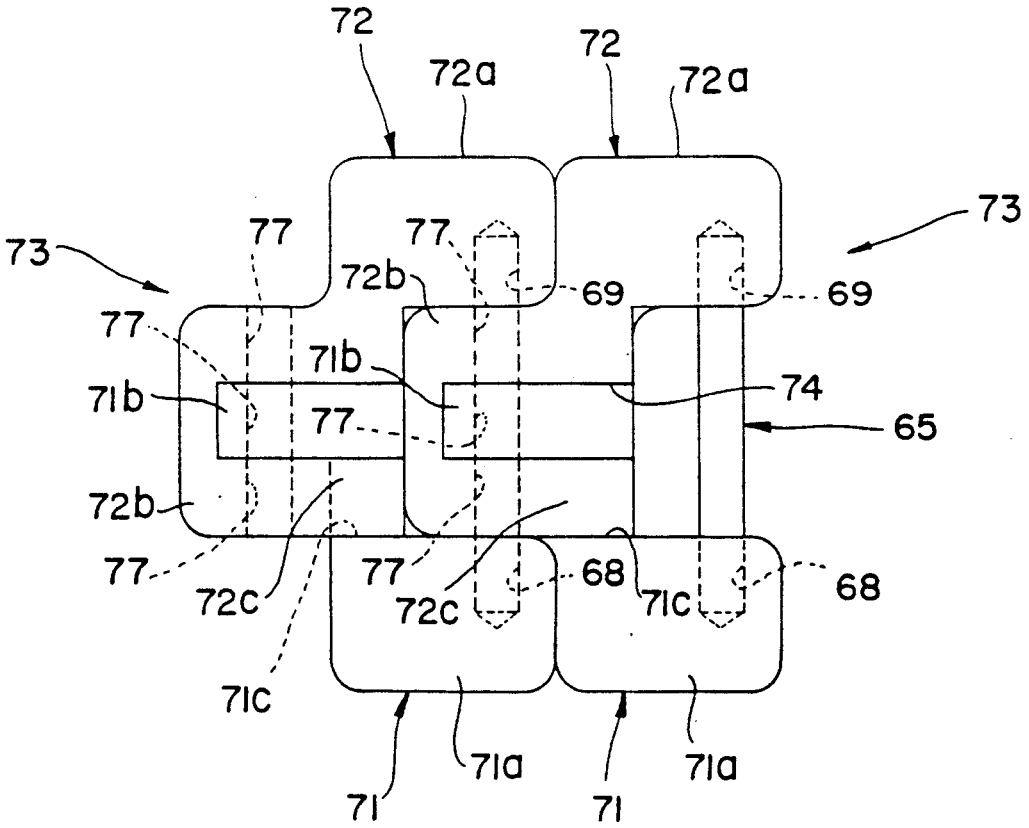
FIG. 21 is a plan view showing an eighth embodiment.

FIGS. 21 to 23 shows the eighth embodiment. A link unit 73 comprises a first link 71 and a second link 72. Referring to FIG. 22, the first link 71 has a body 71*a* and an L-shaped engaging projection 71*b* projected from the inner side of the body 71*a* to the link 72. The second link 72 has a body 72*a* and a U-shaped engaging projection 72*b* projected from the inner side of the body 72*a* to the link 71. A groove 71*c* is provided on the engaging projection 71*b* of the link 71. An engaging plate 72*c* is projected from an end of the engaging projection 72*b* of the link 72 so as to engage with the groove 71*c*. An end portion of the engaging projection 71*b* is provided to be engaged with a recess 74 of the engaging projection 72*b*.

Operation for connecting the links 71 and 72 and the link units 73 will be described hereinafter.

The end of the pin 65 is inserted into the blind hole 68 of the first link 71. The link 72 is positioned at an angle of 90° to the link 71 and the other end of the pin 65 is inserted into the blind hole 69 of the link 72.

The link 72 is rotated 90° about the pin 65 so as to flush the surface of the link 71 with the surface of the link 72. The engaging plate 72*c* of the engaging projection 72*b* of the link 72 is engaged with the groove 71*c* provided on the engaging projection 71*b* of the link 71, while the end portion of the engaging projection 71*b* of the link 71 is engaged with the recess 74 of the engaging projection 72*b* of the link 72, so that the links 71 and 72 are not released from the pin 65. Thus, the link unit 73 is formed.

An end of another pin 65 inserted into the hole 68 of the link 71 of the adjacent link unit 73 is inserted into the through holes 77 of the links 71 and 72 of the assembled link unit 73, respectively.

The other link 72 is positioned at an angle of 90° to the link 71 of the adjacent link unit 73 and an end of the pin 65 is inserted into the hole 69 of the link 72.

The link 72 is rotated 90° about the pin 65 so as to flush the surface of the link 71 with the surface of the link 72 so that the engaging plate 72*c* of the link 72 is engaged with the groove 71*c* of the link 71. Thus, the link units 73 are connected with each other.

In order to disconnect the link from the band, the reverse manner of engaging the links is performed.

Figure 24:
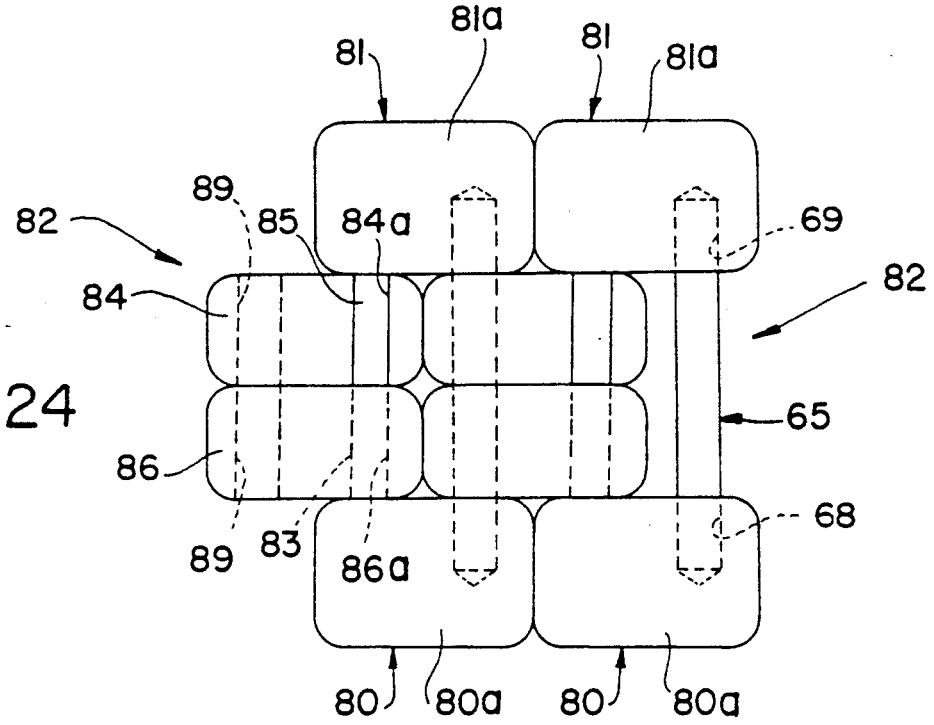
FIG. 24 is a plan view showing a ninth embodiment.
Figure 25:
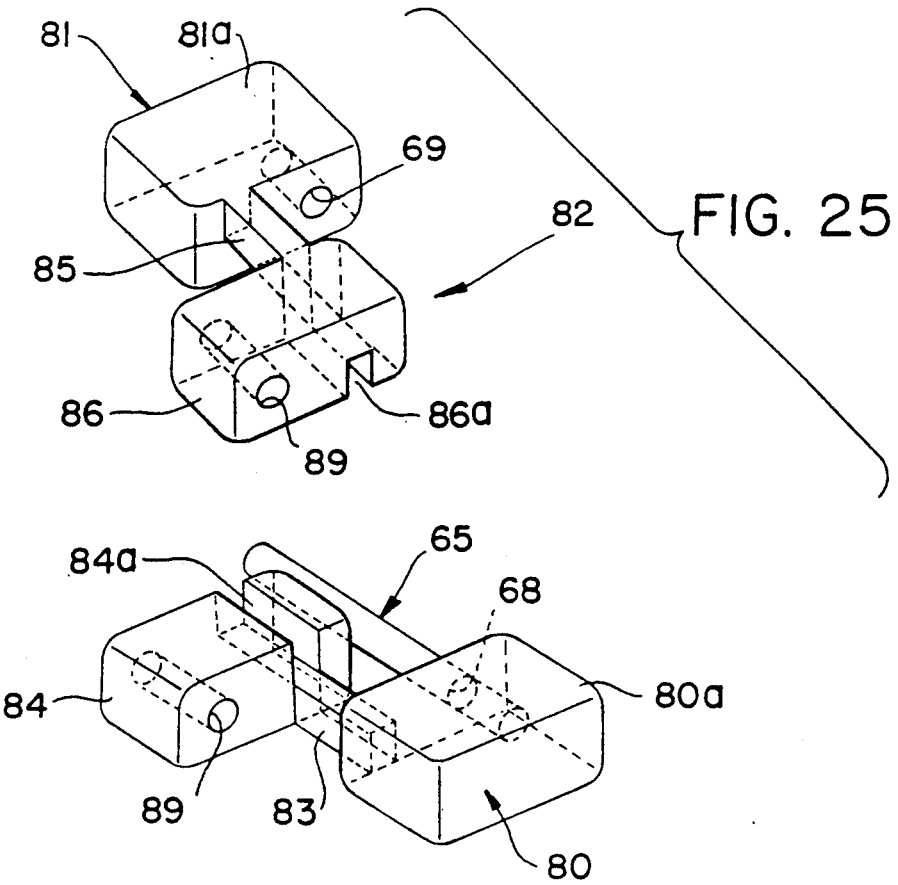
FIG. 25 is an exploded perspective view showing a link unit of FIG. 24.
Figure 26:
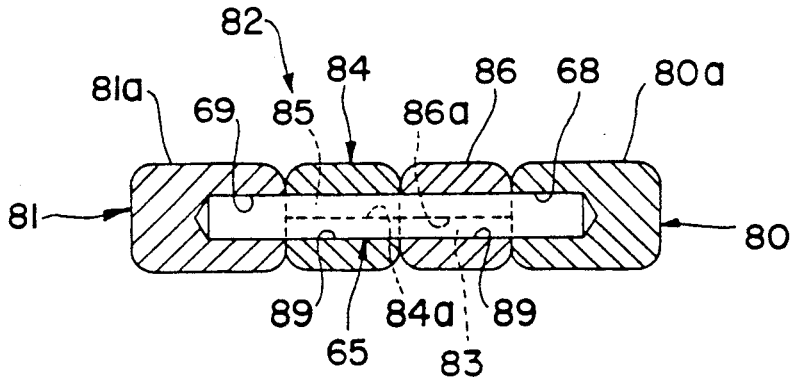
FIG. 26 is a sectional view showing link units in a connecting state.

Referring to FIGS. 24 to 26 showing the ninth embodiment, a link unit 82 comprises a first link 80 and a second link 81. Referring to FIG. 25, a body 80*a* of the first link 80 has an engaging projection 84 having the same shape as the body 80*a* projected from the inner side of the body 80*a* to the link 81 through an engaging projection arm 83. A body 81*a* of the second link 81 has an engaging projection 86 having the same shape as the body 81*a* projected from the inner side of the body 81*a* to the link 80 through an engaging projection arm 85. The engaging projection 84 of the link 80 has an engaging groove 84*a* formed in the upper portion thereof for receiving the engaging projection arm 85 of the link 81. The engaging projection 86 of the link 81 has an engaging groove 86*a* formed in the underside thereof so as to engage with the engaging projection arm 83 of the link 81.

Operation for connecting the links 80 and 81 and the link units 82 will be described hereinafter.

The end of the pin 65 is inserted into the blind hole 68 of the link 80. The link 81 is positioned at an angle of 90° to the link 80, and the other end of the pin 65 is inserted into the blind hole 69 of the link 81.

The link 80 is rotated 90° about the pin 65 so as to flush the surface of the link 80 with the surface of the link 81.

An end of the pin 65 inserted into the blind hole 68 of the link 80 of the adjacent link unit 82 is inserted into the through hole 89 of the link 81 and the through hole 89 of the link 80 of the assembled link unit 82.

The link 81 is positioned at an angle of 90° to the link 80 of the adjacent link unit 82 and an end of the pin 65 is inserted into the blind hole 69 of the link 81.

Both links are rotated 90° about the pin 65 so as to flush the surfaces of both links with each other.

Figure 27:
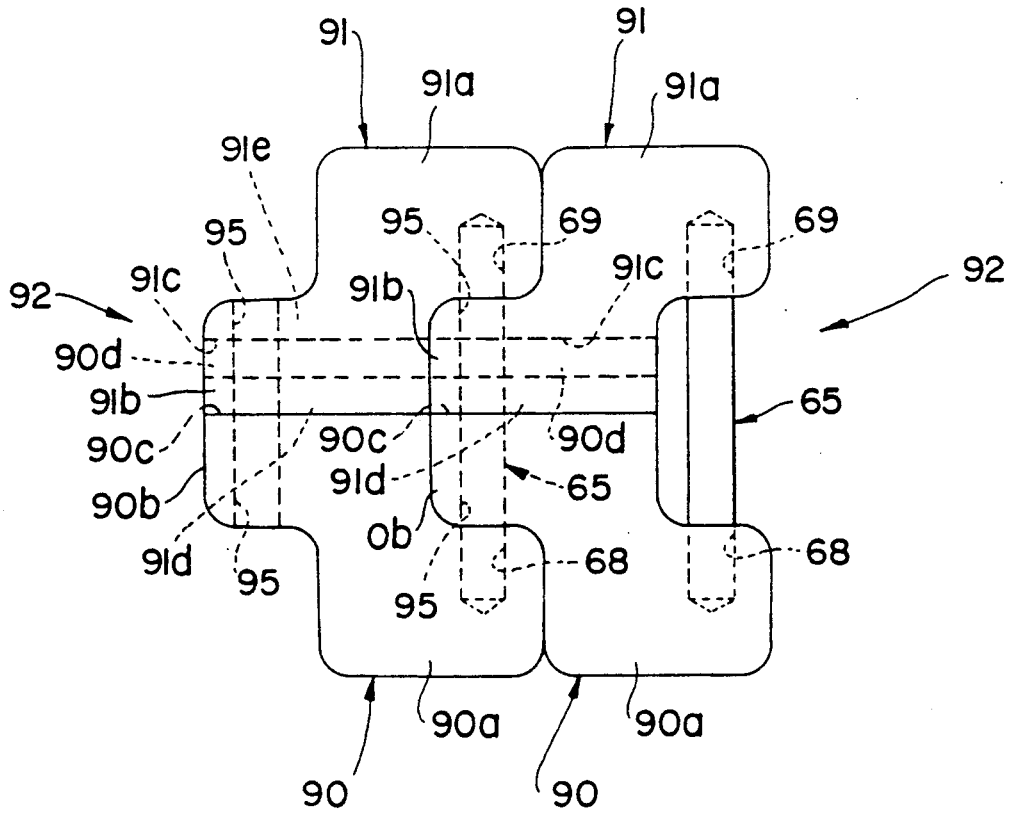
FIG. 27 is a plan view showing a tenth embodiment.
Figure 28:
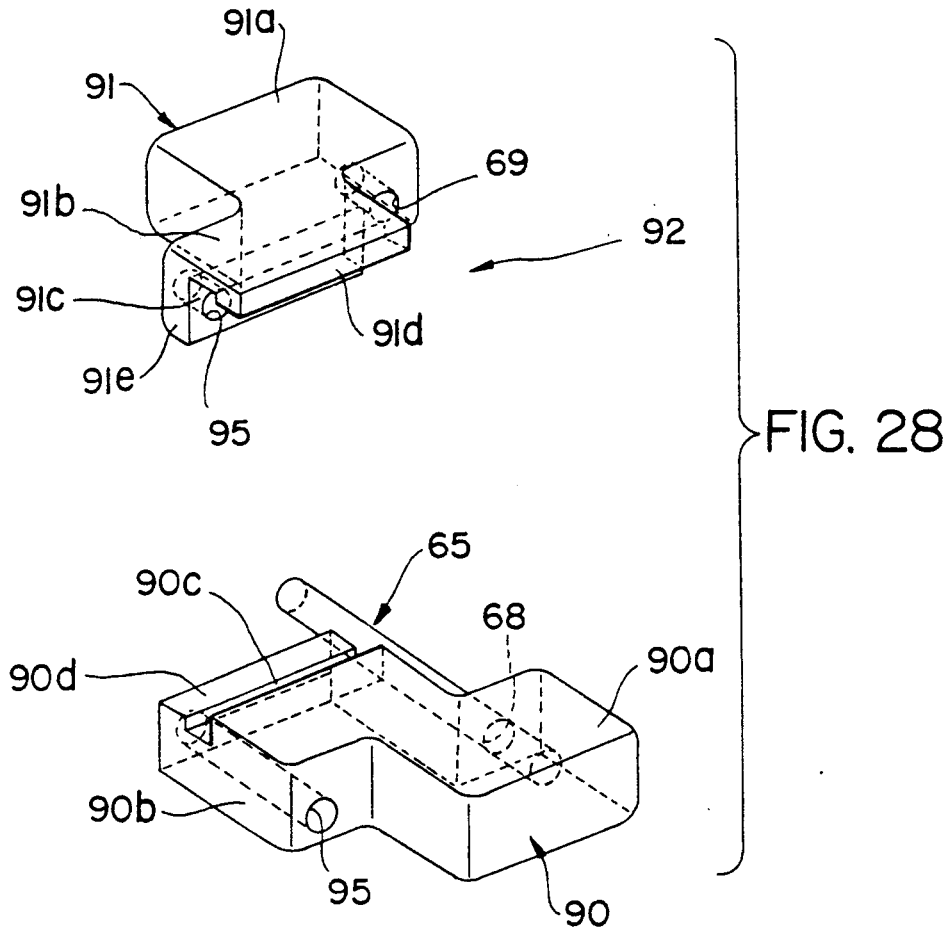
FIG. 28 is an exploded perspective view showing a link unit of FIG. 27.
Figure 29:
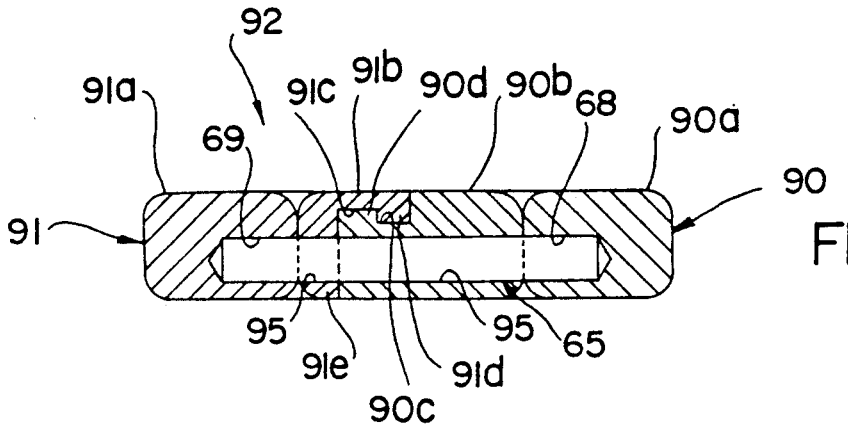
FIG. 29 is a sectional view showing link units in a connecting state.

Referring to FIGS. 27 to 29 showing the tenth embodiment, a link unit 92 comprises a first link 90 and a second link 91. The first link 90 has a body 90*a* and a wide projection 90*b* projected from the inner side of the body 90*a* to the second link 91. The second link 91 has a body 91*a* and a narrow projection 91*b* projected from the inner side of the body 91*a* to the link 90. The wide projection 90*b* of the link 90 has a notch 90*c* formed in the upper portion thereof and an engaging projection 90*d* formed on a side of the notch 90*c*. In the underside of the narrow projection 91*b* of the link 91, a notch 91*c* is formed so as to engage with the engaging projection 90*d*. An engaging projection 91*d* is formed on a side of the notch 91*c* and an engaging support portion 91*e* is provided on the other side of the notch 91*c* opposite to the engaging projection 91*d*.

Operation for connecting the links 90 and 91 and the link units 92 will be described hereinafter.

The end of the pin 65 is inserted into the blind hole 68 formed on the body 90*a* of the first link 90. The link 91 is positioned at an angle of 90° to the link 90, and the other end of the pin 65 is inserted into the blind hole 69 of the link 91.

The link 91 is rotated 90° about the pin 65 so as to flush the surfaces of both links, so that the notch 90*c* provided in the wide projection 90*b* of the link 90 is engaged with the engaging projection 91*d* of the link 91, while the notch 91*c* formed in the underside of the narrow projection 91*b* of the link 91 is engaged with the engaging projection 90*d* of the link 90. Thus, the links 90 and 91 are not released from the pin 65 and the link unit 92 is formed.

An end of the pin 65 is inserted into the blind hole 68 of the link 90 of the adjacent link unit 92 is inserted into the perforated hole 95 formed in the wide projection 90*b* of the link 90 and through blind hole 95 formed in the engaging support portion 91*e* of the link 91 of the assembled link unit 92.

The link 91 is positioned at an angle of 90° to the link 90 of the adjacent link unit 92, and an end of the pin 65 is inserted into the blind hole 69 of the link 91.

The link 91 is rotated 90° about the pin 65 so as to flush the surfaces of both links with each other, so that the notch 90*c* of the link 90 is engaged with the engaging projection 91*d* of the link 91, while the notch 91*c* formed in the underside of the narrow projection 91*b* of the link 91 is engaged with the engaging projection 90*d* of the link 90. Thus, the link units 92 are connected with each other.

In the embodiments of the present invention, a pin is separately formed from links. However, an end of the pin can be previously secured to one of the links.

PROBABILITY OF INDUSTRIAL EXPLOITATION

In accordance with the present invention, links for the band are rotated about the pin to engage one link with the other link. Thus, operation for connection and disconnection of the link units can be easily performed, so that the length of the band can be easily adjusted.

Since holes for pins are not formed on the lateral sides of the band with respect to the longitudinal direction, the band having a good appearance with a high grade is provided. Further, each link is manufactured in an independent process, the bands having various tones and patterns of surfaces can be easily made.

We claim:

1. An adjustable watch band comprising a plurality of link units, each of said link units having a first side and a second side, each of said sides facing in the longitudinal direction of the watch band, said first side having an engaging projection portion, said second side having a recess section, said recess section generally corresponding in shape to said engaging projection portion, adjacent said link units being connected by engaging said engaging projection portion to one of said link units with said recess section of another of said link units, wherein each of said link units includes a first link and a second link;

each of said first and second links having a body, said body having an inner side and an outer side substantially parallel with the longitudinal axis of the band, a projection projecting from said inner side of said body in the lateral direction of the band and extending in the longitudinal direction of the band, and a notch portion formed by a base end side of said projection and said inner side of said body;

said body having a blind hole formed in said inner side and extending in the lateral direction of the band;

said projection having a through hole extending in the lateral direction of the band;

said projection and said notch portion of said first link having shapes so as to form said engaging projection portion and said recess section of said link unit by adjoining with said projection and said notch portion of said second link;

a connecting pin, said connecting pin having an inner end portion and an outer end portion, said inner end portion being engageable with said blind hole of said body of said first link, said connecting pin being slidably engaged with said through holes of said projections of said second link unit adjacent to said first link unit, and slidably and rotatably engaged with said blind hole of said second link of said first link unit so that said second link may be pivoted and slided on said connecting pin; and means for preventing said first and second links from moving in the lateral direction of the band when said first and second links are disposed substantially co-planarly, and for allowing movement of said links in the lateral direction of the band when said first and second links are relatively angularly displaced about said connecting pin.

2. The watch band according to claim 1 wherein said means includes a flat portion formed on an outer end portion of said connecting pin along the longitudinal axis of said connecting pin, an annular groove formed on said connecting pin, said groove being adjacent an inner side of said flat portion, and an inward protrusion formed in said blind hole of said body of said second link in which said outer end portion of said connecting pin is inserted, said flat portion and said annular groove being formed such that said flat portion passes said inner protrusion and said annular groove engages with said inner protrusion when said first and second links are relatively angularly displaced about said connecting pin.

3. The watch band according to claim 1 wherein said means for preventing movement of the links in the lateral direction of the band includes a first step portion and a first recess portion formed on said projection of said first link and a second step portion and a second recess portion formed on said projection of said second link, said step portions and said recess portions being formed such that said first step portion matingly engages with said second recess portion and said second step portion matingly engages with said first recess portion when said first and second links are disposed substantially co-planarly.

* * * * *